US006527401B1

(12) United States Patent
Chu

(10) Patent No.: US 6,527,401 B1
(45) Date of Patent: Mar. 4, 2003

(54) ELECTROLUMINESCENT LIGHTING DEVICE

(75) Inventor: Jackson Luk Wah Chu, Hong Kong (HK)

(73) Assignee: Ewig Industries Co. Ltd., Hong Kong (HK)

( * ) Notice: Subject to any disclaimer, the term of this patent is extended or adjusted under 35 U.S.C. 154(b) by 0 days.

(21) Appl. No.: 09/990,793

(22) Filed: Nov. 14, 2001

(51) Int. Cl.[7] ..... H05B 33/02
(52) U.S. Cl. ..... 362/84; 362/217
(58) Field of Search ..... 362/84, 216, 217, 362/222; 313/511

(56) References Cited

U.S. PATENT DOCUMENTS 3,317,722 A * 5/1967 Whitney ..... 313/512
5,315,491 A * 5/1994 Spencer et al. ..... 313/114
5,496,427 A * 3/1996 Gustafson et al. ..... 156/244.12
5,499,170 A * 3/1996 Gagne ..... 362/153
5,775,016 A * 7/1998 Chien ..... 362/570

* cited by examiner

*Primary Examiner*—Sandra O'Shea
*Assistant Examiner*—Hargobind S. Sawhney
(74) *Attorney, Agent, or Firm*—Jackson Walker L.L.P.

(57) ABSTRACT

An electroluminescent lighting device includes a elongate flexible body having an inner part and an outer part, an elongate multi-layer electroluminescent strip including a pair of co-extending conductive regions and extending along the inner body part, and a pair of conductive wires extending along the inner body part for supplying electrical power to the strip. The wires are separated from the strip by at least a portion of the inner body part, A number of flexible contact elements are located at intervals along the inner body part for electrically connecting the conductive regions to the wires. Each contact element contacts with a respective conductive region and extends through the portion of the inner body part to contact a respective wire.

17 Claims, 4 Drawing Sheets

ELECTROLUMINESCENT LIGHTING DEVICE

The present invention relates to an electroluminescent lighting device that is elongate and flexible for various lighting purposes.

BACKGROUND OF THE INVENTION

Electroluminescent lighting devices have been known in general, which typically have a multi-layer structure including, for example, an indium tin oxide layer deposited on a substrate. This may be covered by a layer containing phosphorus or similar material. An additional dielectric layer may overlie the phosphorus layer, which is typically a barium titanium oxide layer such as barium titanate.

The structure may further include a conductive layer of silver ink, carbon or the like for the conduction of electrical current and, finally, an insulating transparent or translucent outermost plastic layer or the like for protection.

Upon the passage of an alternating or pulsating direct current through the layers, including the indium tin oxide and silver ink or carbon layers, there is a general migration of electrons that release energy as light during the process. The released light can be emitted through surrounding layers to provide light from the devices as a whole.

Although such devices have been around for many years, they have generally been used as back-lights or illuminating signs on a rigid support. Although devices in a flexible cable form is also known, for example as disclosed in U.S. Pat. No. 5,485,355, their constructions that enable the conduction of electrical current are found to be complicated and/or unreliable.

The invention seeks to mitigate or to at least alleviate such problems by providing an improved electroluminescent lighting device.

SUMMARY OF THE INVENTION

According to one aspect of the invention, there is provided an electroluminescent lighting device comprising a elongate flexible body having an inner part and an outer part, said outer part being of a transparent or translucent material, a elongate multi-layer electroluminescent element including a pair of co-extending conductive regions and extending along the inner body part, a pair of elongate conductors extending along the inner body part for supplying electrical power to the electroluminescent element, said conductors being separated from the electroluminescent element by at least portion of the inner body part, and a plurality of flexible contact elements located at intervals along the inner body part for electrically connecting the conductive regions of the electroluminescent element to the conductors, each said contact element having a first part in contact with a respective said conductive region and a second part extending through said portion of the inner body part and contacting a respective said conductor.

Preferably, the electroluminescent element is supported by the inner body part.

More preferably, the inner body part is formed with a channel holding the electroluminescent element therein.

Further more preferably, the channel has an open side having a reduced width which is smaller than the width of the electroluminescent element.

It is preferred that the electroluminescent element has a flat cross-section and opposite edges, along which edges the conductive regions extend respectively in a continuous manner.

Preferably, the conductors are embedded within the inner body part.

It is preferred that the conductors are provided by respective stranded metal wires.

In one preferred embodiment, the flexible contact elements are formed as conductive resilient inserts.

Preferably, at least some of the inserts are of conductive rubber.

In another preferred embodiment, at least some of the flexible contact elements are formed of wire.

Preferably, the wires are soldered to the elongate conductors.

Preferably, the wires are clipped through the conductive regions of the electroluminescent element.

According to another aspect of the invention there is provided a method of forming the above-disclosed electroluminescent lighting device, the method comprising: cutting a plurality of access cavities in the inner body part, inserting a conductive rubber piece into each cavity to come into contact with one of said elongate conductors and installing the electroluminescent element into the inner body part so that each of said elongate conductors and one of said conductive regions of the electroluminescent element comes into contact with one or more of said conductive rubber pieces.

In yet a further aspect of the invention there is provided a method of forming the above-disclosed electroluminescent lighting device, the method comprising taking the inner body part and cutting a plurality of access cavities therein to expose portions of each elongate conductor and said conductive regions, the method further comprising attaching respective pieces of flexible wire to each exposed portion of each elongate conductor and attaching each piece of flexible wire to a corresponding exposed portion of the respective conductive region.

It is further preferred that the outer body part is extruded onto the inner body part to form the complete electroluminescent lighting device.

BRIEF DESCRIPTION OF DRAWINGS

The invention will now be more particularly described, by way of example only, with reference to the accompanying drawings, in which.

DETAILED DESCRIPTION OF THE PREFERRED EMBODIMENTS

Figures 1, 2:
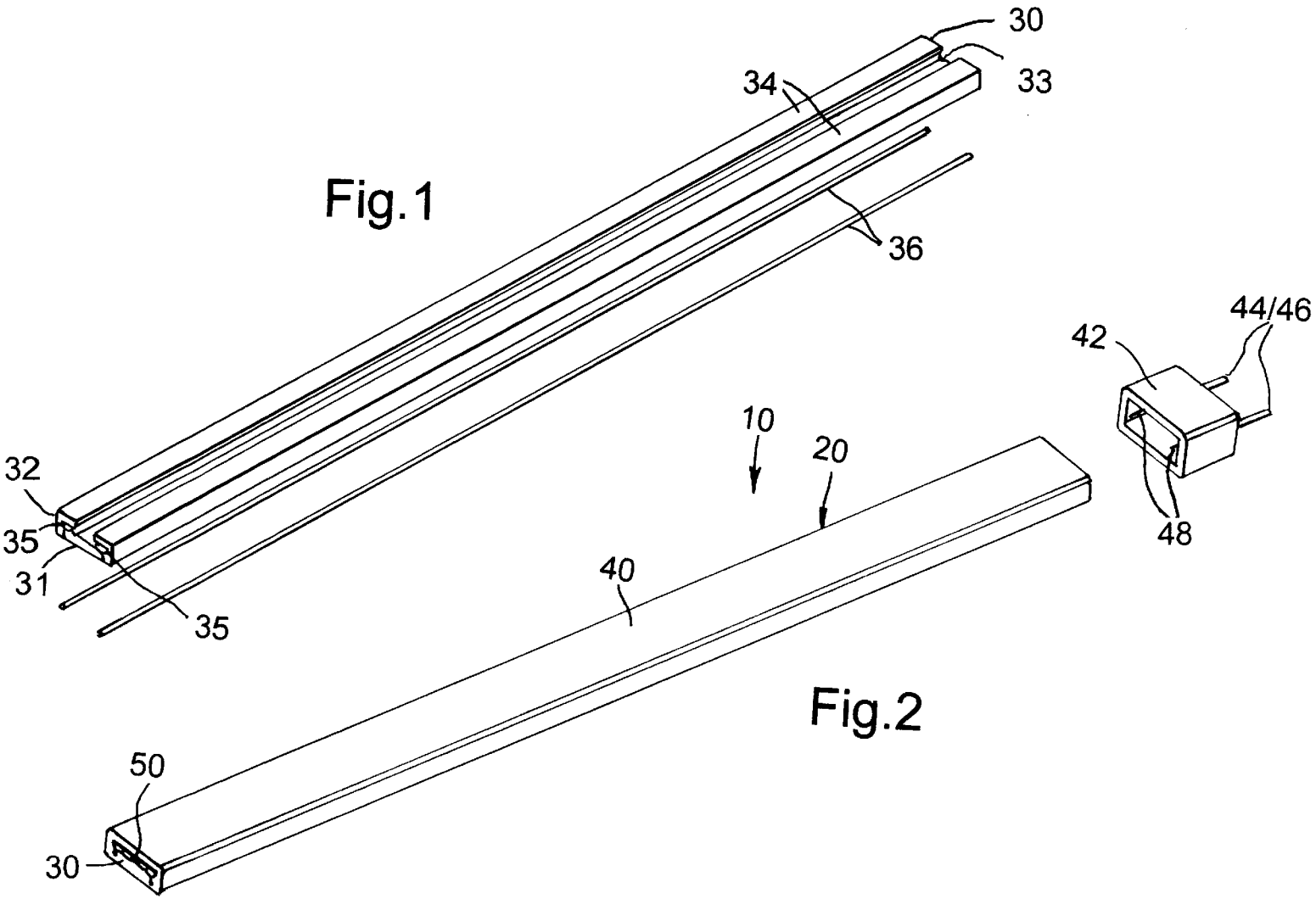
FIG. 1 is a perspective view of an inner body part of an electroluminescent lighting device.
FIG. 2 is a schematic perspective view of a portion of a finished electroluminescent lighting device including its outer body part an electrical connector.
Figure 3:
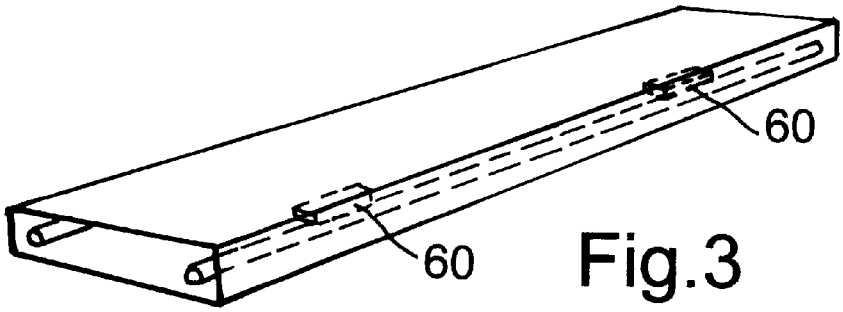
FIG. 3 is a schematic perspective illustration of an electroluminescent lighting device having conductive rubber contacts therein.
Figure 4:
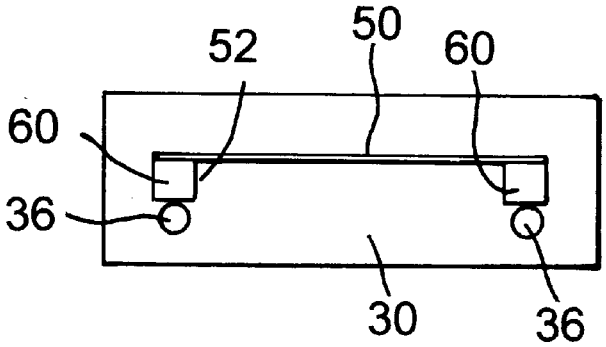
FIG. 4 is a schematic end elevational view of the embodiment of FIG. 3.
Figure 5:
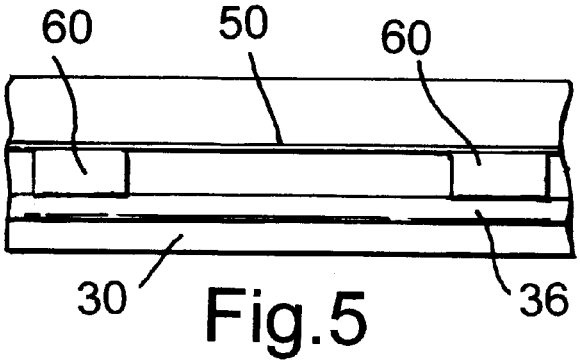
FIG. 5 is a schematic side elevational view of a portion of the embodiment of FIG. 3.

Referring to the drawings, there is shown an electroluminescent lighting device or light 10 embodying the invention, which light 10 is of an indefinite length and has a elongate flexible body 20 made of a transparent or translucent material such as plastic including polyvinyl chloride in particular. The body 20 is manufactured initially as an extruded inner base strip 30 (FIG. 1) which is finally enclosed by an outer sheath 40 of the same or like material extruded thereon for protection (FIG. 2).

The base strip 30 has a generally flat rectangular channel shaped cross-section consisting of a lower part 31 and an upper part 32, in which upper part 32 a channel 33 is formed. The upper part 32 includes a pair of co-extending horizontal integral flanges 34 on opposite sides of the channel 33, which lie on the same plane parallel to and immediately above the channel 33. The flanges 34 extend laterally over part of the opposite sides of the channel 33, thereby reducing the width of the channel open side and forming a pair of opposed side grooves 35 facing each other.

During extrusion of the base strip 30, a pair of electrically conductive metal stranded wires 36, for example made of copper, is embedded within opposite sides of the lower part 31, each of which is positioned directly below the corresponding side groove 35. The wires 36 serve the purpose of supplying electrical power to the overall electroluminescent light 10, as hereinafter described.

The electroluminescent light 10 includes an electroluminescent strip 50 fitted within the channel 33 of the base strip 30. The electroluminescent strip 50 is manufactured to have a multi-layer structure as referred to in the prior art description above, and has a width smaller than that of the open side of the channel 33 as between the flanges 34. More specifically, the electroluminescent strip 50 has an underside having opposite edges, along which a pair of co-extending continuous electrically conductive tracks 52 (made of silver ink, carbon or the like) is exposed or otherwise provided. While being used in the channel 33, the electroluminescent strip 50 is separated from the wires 36 by the portion of the base strip 30 forming the bottom of the channel 33. The tracks 52 are to be electrically connected to the respective power supply wires 36 by means of a plurality of flexible contact elements 60.

Figure 9:
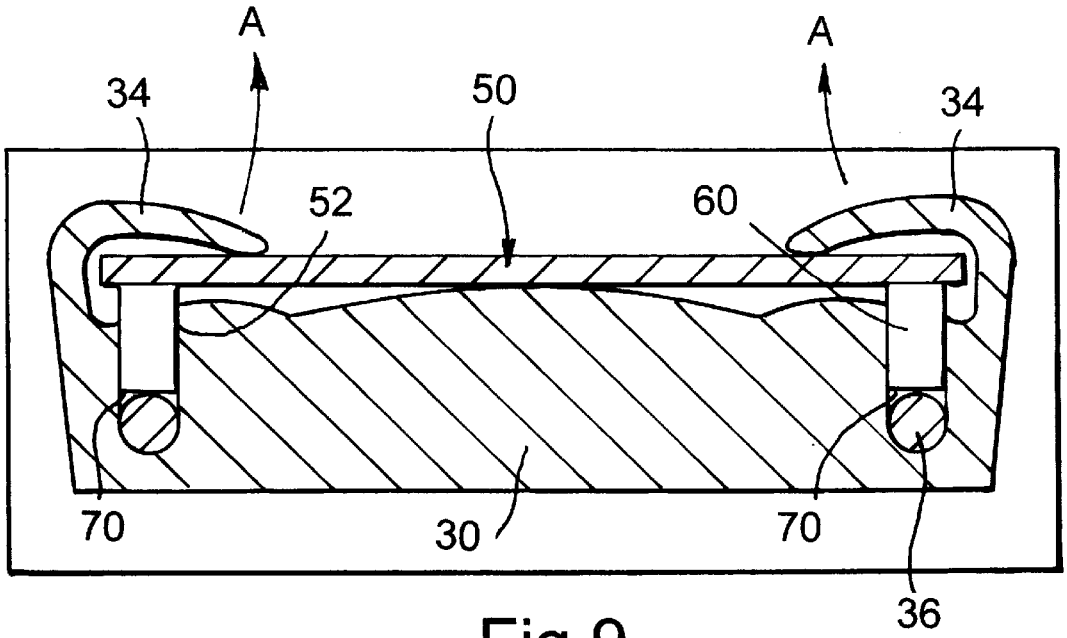
FIG. 9 is a schematic end elevational view of the embodiment of FIG. 3.
Figure 10:
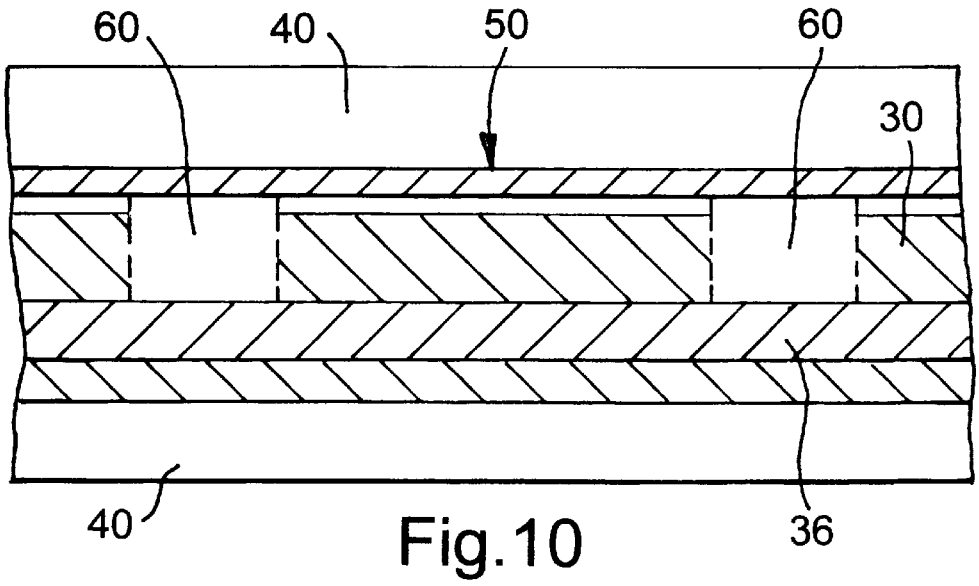
FIG. 10 is a schematic side elevational view of a portion of the embodiment of FIG. 3.

In the embodiment of FIGS. 3, 4, 5, 9 and 10, flexible contact elements 60 are formed of a conductive, resilient material such as conductive rubber. As shown in FIG. 9, the conductive rubber elements 60 extended between the tracks 52 of the electroluminescent strip 50 and an elongate conductor 36. In order to install the contact elements 60, cut-outs 70 are made at each side of the base strip 30 and the conductive rubber 60 in a pre-formed size to fit within the cut-out 70 is pushed into place. To achieve this, prior to installation of the electroluminescent strip 50, the flanges 34 are prised up in the direction indicated by arrows A. This provides vertical, downward access for forming the cut-outs and then inserting the rubber blocks 60. When the cut-out 70 are formed, portions of the elongate conductors 36 are exposed for contact by the conductive rubber blocks.

Figure 6:
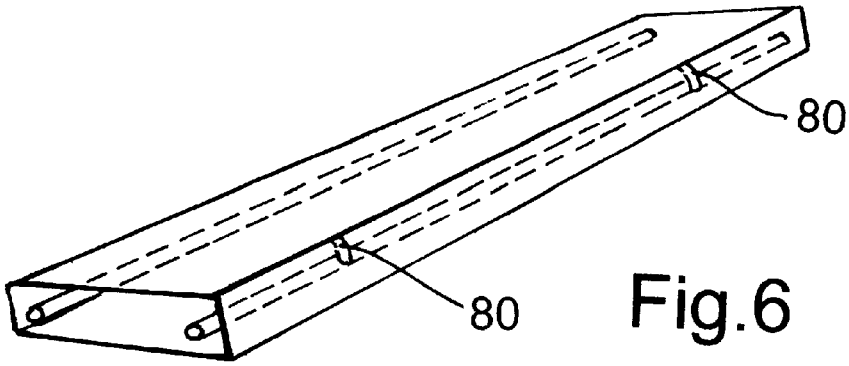
FIG. 6 is a schematic perspective view of an electroluminescent lighting device having flexible metallic wire contacts.
Figure 7:
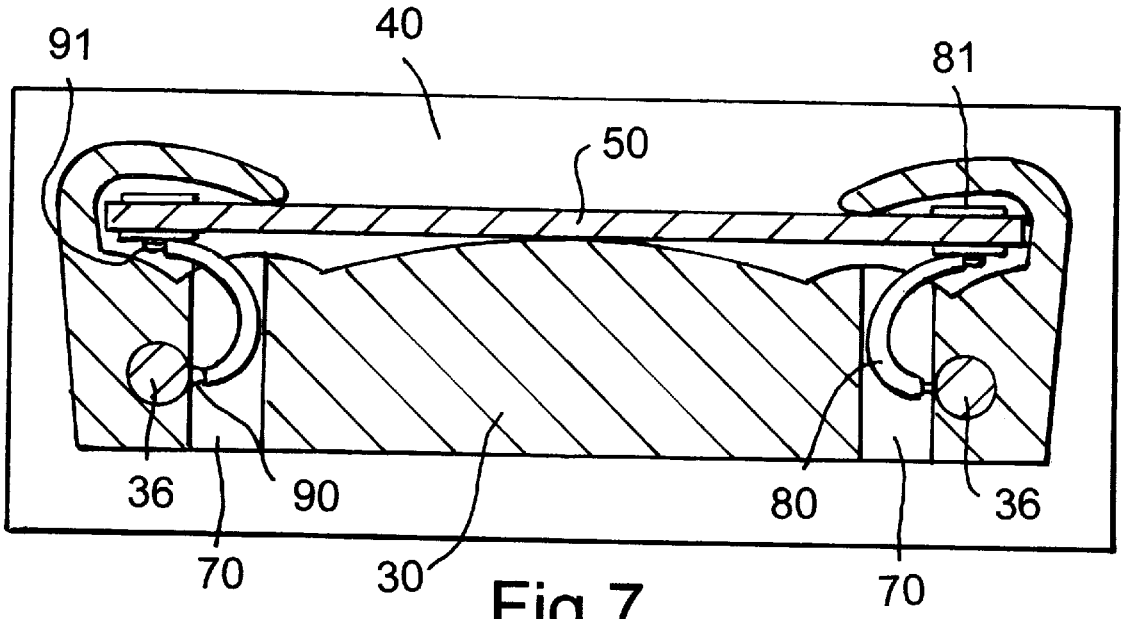
FIG. 7 is a schematic end elevational view of the embodiment of FIG. 6.
Figure 8:
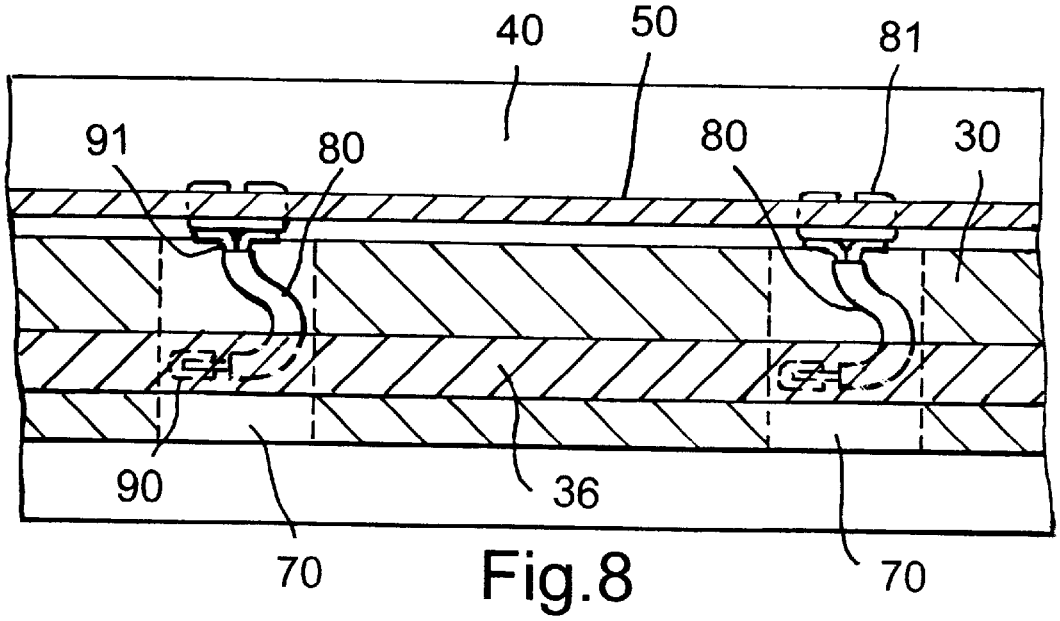
FIG. 8 is a schematic side elevational view of a portion of the embodiment of FIG. 6.

In the embodiment of FIGS. 6, 7 and 8, cut-outs 70 are made through the bottom of the base strip 30. Instead of using conductive rubber or the like, flexible metallic wires 80 are soldered at 90 to the elongate conductors 36. The other end of each wire So is soldered at 91 to a piercing clip 81 in the form of a "U" that has two prongs that are pressed through the conductive regions 52 of the electroluminescent strip 50 and bent down thereon for permanent electrical contact. The cut-outs 70 are spaced along the bottom of the base strip 30.

In both of the embodiments, the outer layer 40 is extruded over the base strip 30 to thereby seal the contact elements in place.

As can be seen, the contact elements 60 or 80 are spaced at regular intervals along and within the base strip 30 which includes the pair of wires 36.

In the embodiment of FIGS. 6, 7 and 8 the electroluminescent strip 50 is inserted into the channel 33 of the base strip 30, while the side flanges 34 are temporarily prised open, and prior to the soldering steps.

The electroluminescent light 10 is cut into a suitable lengths for use, with each end thereof covered by a rectangular plastic end cap 42. One of the end caps 42 incorporates a pair of terminal pins 44 having outer ends 46 and inner ends 48. The outer ends 46 are for connection to an AC or pulsating DC power source. The inner ends 48 are sharp for piercing into the respective end of the base strip 30 and providing electrical connection with the respective wires 36.

The invention has been given by way of example only, and various modifications of and/or alterations to the described embodiments may be made by persons skilled in the art without departing from the scope of the invention as specified in the appended claims. For example, a single eletroluminescent light could be formed with both the flexible rubber type of contact elements and the flexible wire type of elements. These may be regularly or randomly alternated along a single wire 46 or one type might be provided along one of the wires 46 and another type provided along the other wire 46.

What is claimed is:

1. An electroluminescent lighting device comprising a elongate flexible body having an inner part and an outer part, said outer part being of a transparent or translucent material, a elongate multi-layer electroluminescent element including a pair of co-extending conductive regions and extending along the inner body part, a pair of elongate conductors extending along the inner body part for supplying electrical power to the electroluminescent element, said conductors being separated from the electroluminescent element by at least a portion of the inner body part, and a plurality of flexible contact elements located at intervals along the inner body part for electrically connecting the conductive regions of the electroluminescent element to the conductors, each said contact element having a first part in contact with a respective said conductive region and a second part extending through said portion of the inner body part and contacting a respective said conductor.

2. The device of claim 1 wherein the electroluminescent element is supported by the inner body part.

3. The device of claim 1 wherein the inner body part is formed with a channel holding the electroluminescent element therein.

4. The device of claim 3 wherein the channel has an open side having a reduced width which is smaller than the width of the electroluminescent element.

5. The device of claim 1 wherein the electroluminescent element has a flat cross-section and opposite edges, along which edges the conductive regions extend respectively in a continuous manner.

6. The device of claim 1 wherein the conductors are embedded within the inner body part.

7. The device of claim 1 wherein the conductors are provided by respective stranded metal wires.

8. The device of claim 1 wherein the flexible contact elements are formed as a conductive resilient insert.

9. The device of claim 8 wherein at least some of the inserts are of conductive rubber.

10. The device of claim 1 wherein at least some of the flexible contact elements are formed of metalwire.

11. The device of claim 10 wherein the wires are soldered to the elongate conductors.

12. The device of claim 10 wherein the wires are clipped through the conductive regions of the electroluminescent element.

13. A method of forming the electroluminescent lighting device of claim 1, the method comprising:

cutting a plurality of access cavities in the inner body part, inserting a conductive rubber piece into each cavity to come into contact with one of said elongate conductors and installing the electroluminescent element into the inner body part so that each of said elongate conductors and one of said conductive regions of the electroluminescent element comes into contact with one or more of said conductive rubber pieces.

14. The method of claim 13 wherein the outer body part is extruded onto the inner body part to form the complete electroluminescent lighting device.

15. A method of forming the electroluminescent lighting device of claim 1, the method comprising:

taking the inner body part and cutting a plurality of access cavities therein to expose portions of each elongate conductor and said conductive regions, the method further comprising attaching respective pieces of flexible wire to each exposed portion of each elongate conductor and attaching each piece of flexible wire to a corresponding exposed portion of the respective conductive region.

16. The method of claim 15 wherein the pieces of flexible wire are are soldered to each said exposed portion of each elongate conductor.

17. The method of claim 15 wherein each piece of flexible wire is soldered to a clip that is clipped through said corresponding exposed portions of the respective conductive regions.

* * * * *